US005170835A

United States Patent [19]

Eberle et al.

[11] Patent Number: 5,170,835

[45] Date of Patent: Dec. 15, 1992

[54] METHOD AND APPARATUS FOR MANUFACTURING BATTERIES

[75] Inventors: Kelly L. Eberle, Irving; William K. Eberle, Euless; Terry R. Eberle, Red Oak, all of Tex.

[73] Assignee: Eberle Equipment Inc., Dallas, Tex.

[21] Appl. No.: 652,665

[22] Filed: Feb. 8, 1991

[51] Int. Cl.[5] ..... B22D 19/04; B22D 23/04; B22D 25/04

[52] U.S. Cl. ..... 164/108; 164/133; 164/136; 164/334; 164/337

[58] Field of Search ..... 164/98, 133, 136, 119, 164/130, 337, 334, 316, 318, DIG. 1, 108

[56] References Cited

U.S. PATENT DOCUMENTS

| | | | |
|---|---|---|---|
| 812,329 | 2/1906 | Daugherty | 164/316 |
| 3,504,731 | 4/1970 | Farmer | 164/334 X |
| 4,175,725 | 11/1979 | Cattano | 164/DIG. 1 X |
| 4,289,193 | 9/1981 | Stamp | 164/DIG. 1 X |
| 4,428,413 | 1/1984 | Lester | 164/457 X |
| 4,852,631 | 8/1989 | Herbin et al. | 164/133 X |

FOREIGN PATENT DOCUMENTS

| | | | |
|---|---|---|---|
| 1022935 | 12/1952 | France | 164/136 |
| 58-19859 | 2/1983 | Japan | 164/DIG. 1 |
| 1176508 | 10/1988 | U.S.S.R. | 164/133 |

*Primary Examiner*—J. Reed Batten, Jr.
*Attorney, Agent, or Firm*—Timmons & Kelly

[57] ABSTRACT

A pot of molten lead is situated adjacent to a mold chamber containing a mold. A displacement piston is lowered into the pot to displace lead into the mold chamber to fill the mold. The displacement piston them allows the lead to flow back into the pot, leaving the lead in the mold. A battery handler then lowers a battery into the mold to cast lead straps onto the lugs of the battery. Water is forced through a passageway in the mold chamber to cool the lead in the mold. Air is then forced through the passageway to remove the water. The battery handler then removes the battery from the mold and a heating unit begins to preheat the mold chamber for the next battery.

20 Claims, 5 Drawing Sheets

METHOD AND APPARATUS FOR MANUFACTURING BATTERIES

BACKGROUND OF THE INVENTION

1. Field of the Invention

This invention relates in general to the manufacture of storage batteries. In particular, the invention relates to the manufacture of lead acid batteries of the type used in computers.

2. Description of the Prior Art

In the past, lead straps have been cast onto batteries in a variety of ways. Usually, the molten lead has been poured into the molds before the battery lugs are inserted into the lead. This step of pouring the molten lead has been dangerous, causing many industrial accidents. Also, the prior art methods have been wasteful and slow, as the molten lead is carried from the point where the lead is melted to the molds.

SUMMARY OF THE INVENTION

The general object of the invention is to provide a method and apparatus for casting lead straps onto the lugs of a battery during the manufacture of the battery. In general this object is accomplished by the provision of an apparatus including a pot of molten lead, adjacent to a mold chamber containing a mold.

A displacement piston displaces the lead from the pot to the mold chamber to fill the mold with lead. The displacement piston then retracts to allow the lead to flow back into the pot, leaving the mold full of molten lead.

A battery handler inserts the lugs of the battery into the mold. Water is forced through a passageway in the mold chamber to cool the lead in the mold. Air is then forced through the passageway to remove the water.

The battery handler then removes the battery from the mold. A heating unit begins to preheat the mold chamber for the next battery. The method is then repeated for the next battery.

During the operation, a stream of nitrogen is blown over the surfaces of the lead in the pot and the lead in the mold chamber. The nitrogen stream acts as a gaseous blanket to insulate the lead from the atmosphere to prevent oxidation.

The above, as well as additional objects, features, and advantages of the invention will become apparent in the following detailed description.

DETAILED DESCRIPTION OF THE PREFERRED EMBODIMENT

Figure 8:
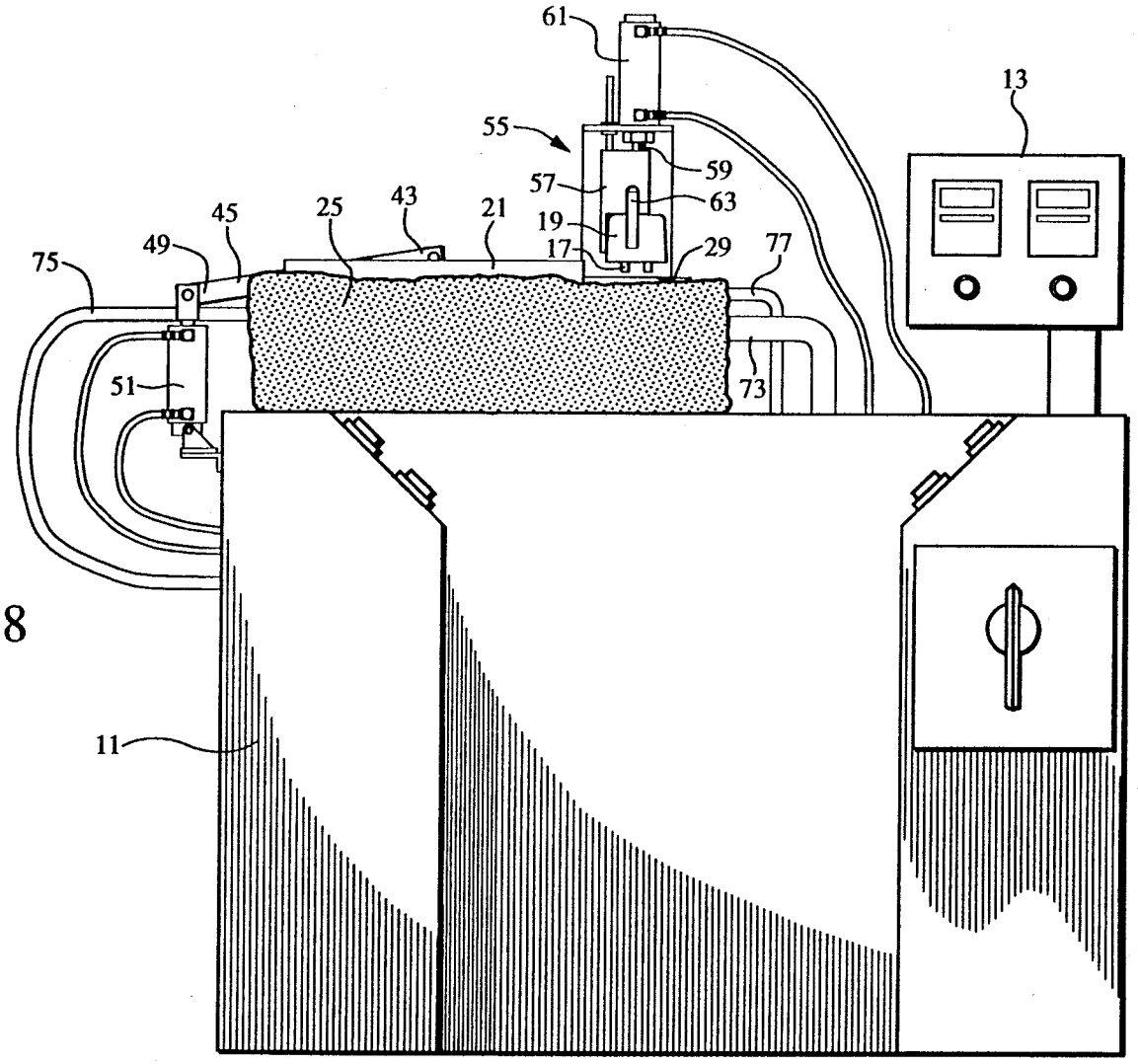
FIG. 8 is a front elevation of the apparatus of the invention.

Looking first at FIG. 8, the apparatus of the invention is mounted on a cabinet 11 housing the computer controls for controlling the operation of the apparatus. The computer controls are programmed using the control panel 13. The computer controls can also be overridden to allow manual control of the operations.

Figure 6:
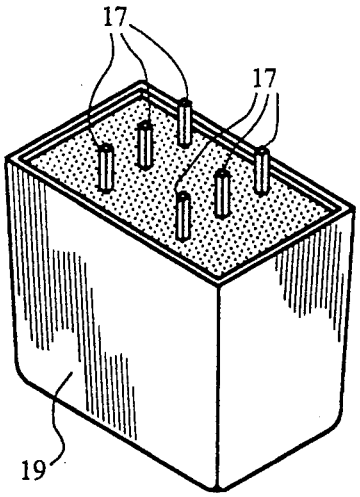
FIG. 6 is a perspective view of a battery prior to the casting of the straps onto the lugs of the battery.
Figure 7:
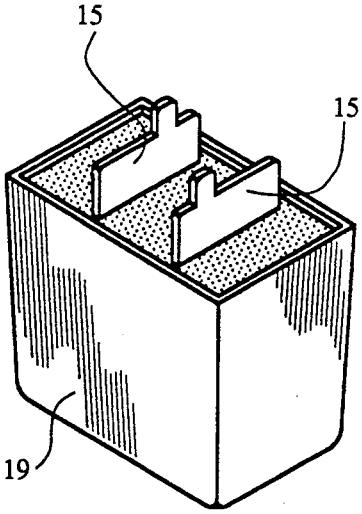
FIG. 7 is a perspective view of the battery after the straps have been cast onto the lugs of the battery.

Turning now to FIGS. 6 and 7, the purpose of the method and apparatus of the invention is to cast lead straps 15 onto the lugs 17 on the battery plates of a battery 19. FIG. 6 shows a battery 19 having a plurality of lugs 17 extending upward from the rest of the battery 19. FIG. 7 shows a battery 19 having a pair of straps 15 that have been cast onto the lugs 17 to electrically connect the lugs 17. The battery 19 is then passed to another apparatus for further manufacturing steps in accordance with well-known practice.

Figure 1:
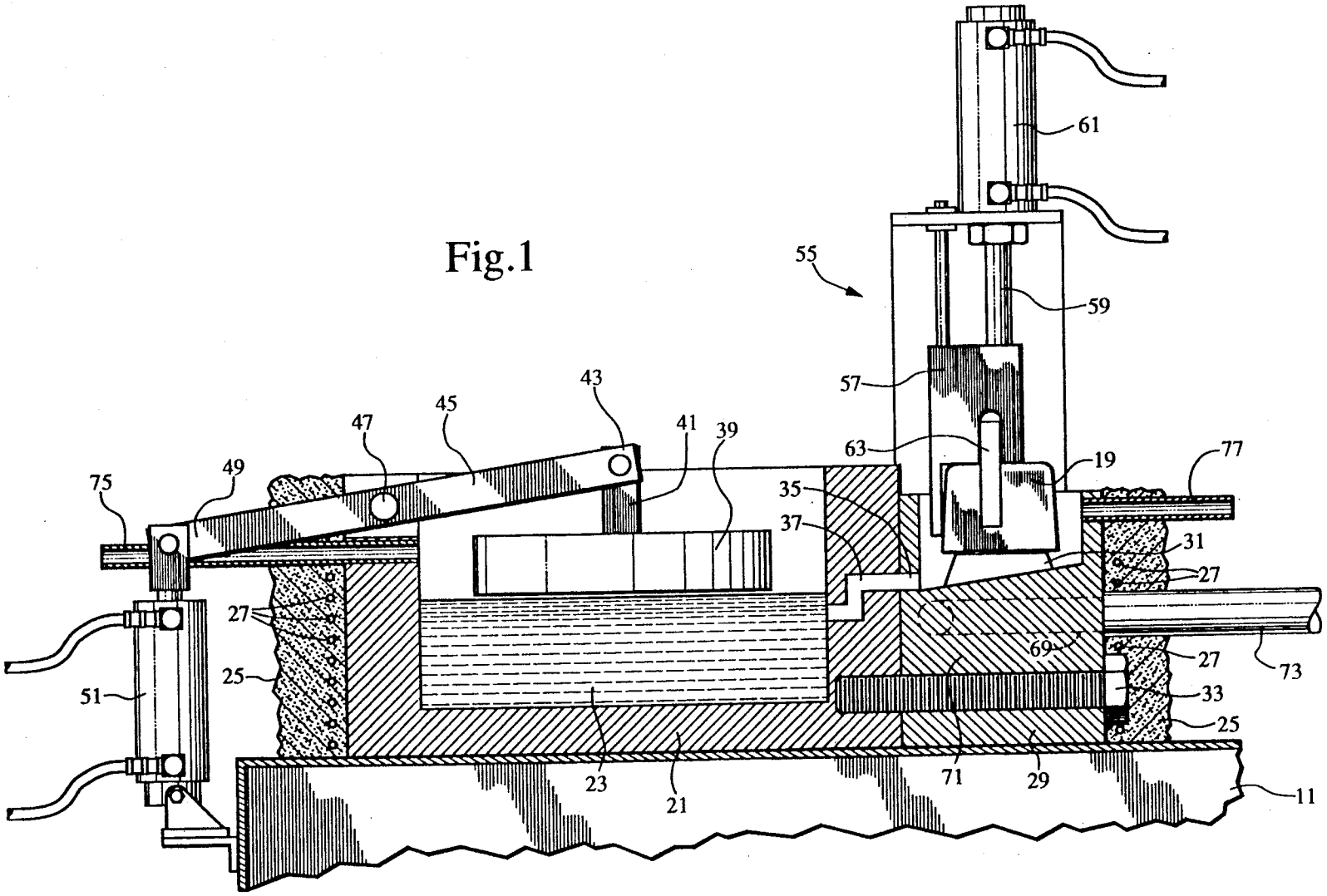
FIG. 1 is a close up front elevation of a portion of the apparatus of the invention, with the displacement piston in the raised position and and the battery handler in the lowered position.
Figure 2:
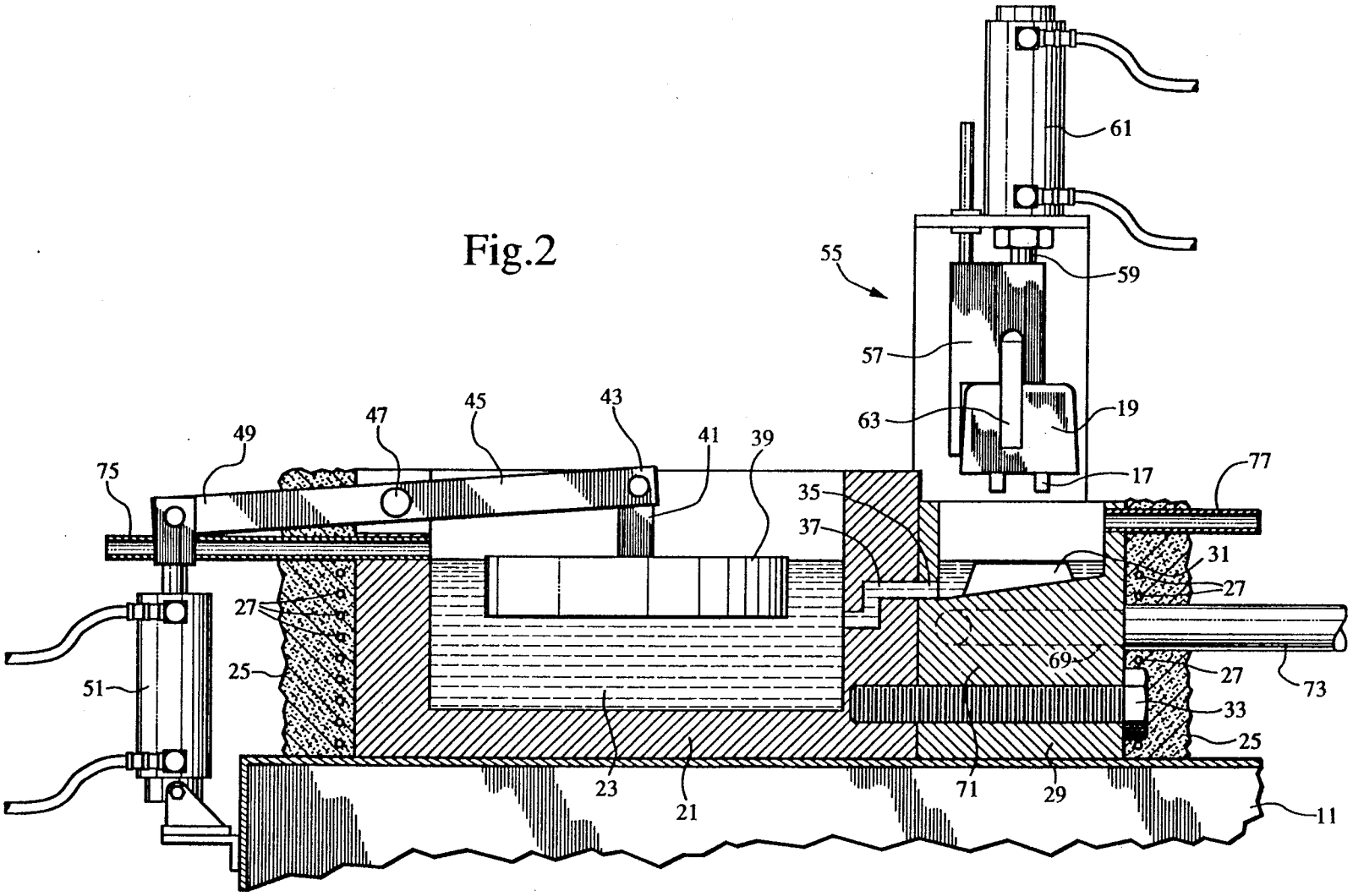
FIG. 2 is a close up front elevation of a portion of the apparatus of the invention, with the displacement piston in the lowered position and and the battery handler in the raised position.
Figure 3:
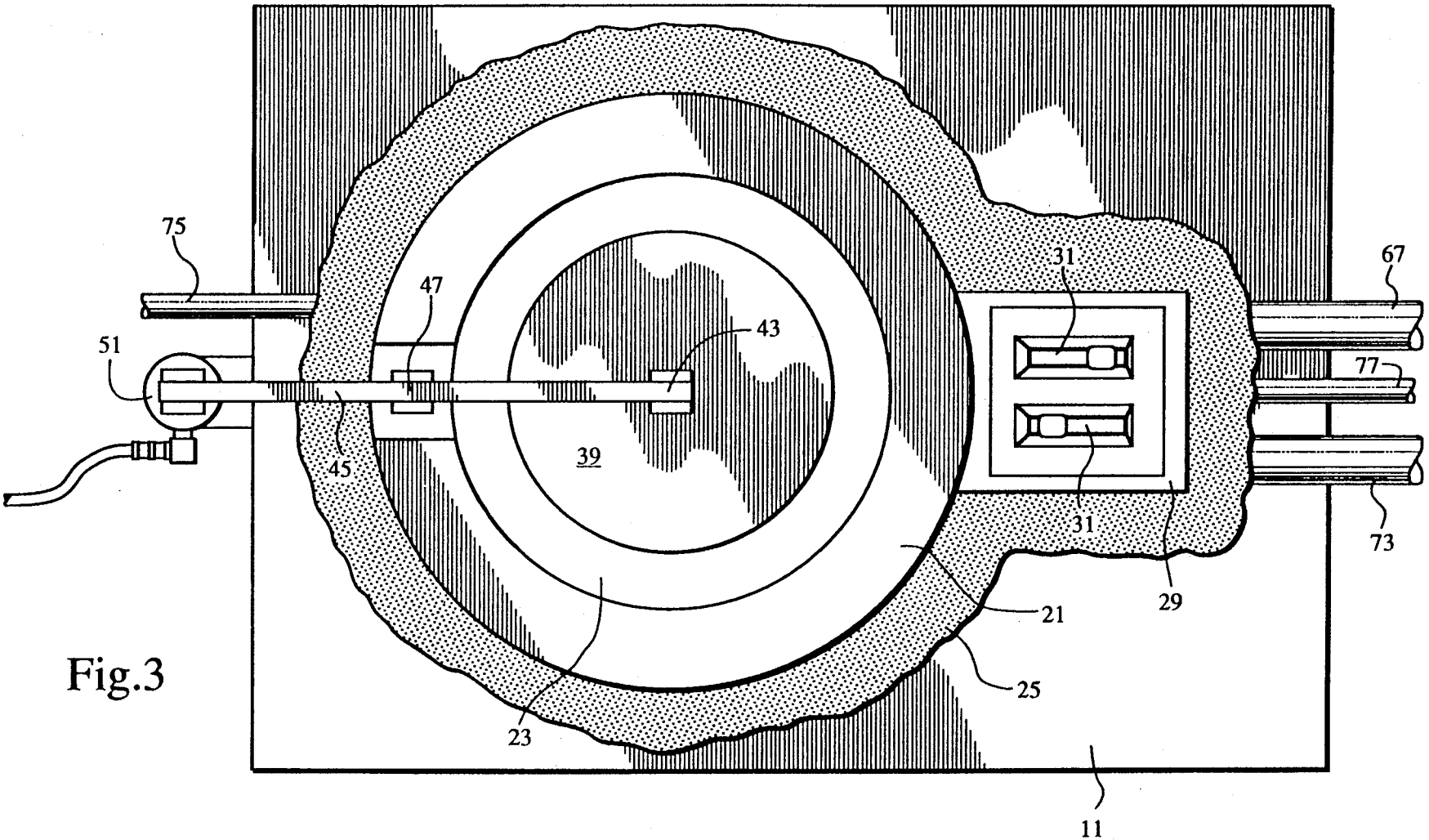
FIG. 3 is a plan view of a portion of the apparatus of the invention.

FIGS. 1-3 show close up views of the major components of the apparatus of the invention. The apparatus of the invention includes a cylindrical pot 21 containing a quantity of molten lead 23. The pot 21 is surrounded by a thermal blanket 25 that contains an electric heating unit 27 for heating the pot 21 to melt the lead 23. If desired, the pot 21 may have a lid covering the top of the pot 21.

Adjacent to the pot 21 is a mold chamber 29. A pair of molds 31 are located in the mold chamber 29. The mold chamber 29 is connected to the pot 21 with a bolt 33, so that the mold chamber 29 can be easily changed if other molds 31 are required. The thermal blanket 25 that surrounds the pot 21 also surrounds the mold chamber 29.

A passageway 35 through the wall of the mold chamber 29 aligns with a passageway 37 through the wall of the pot 21. The passageway 35 through the mold chamber 29 is above the normal level of the molten lead 23 in the pot 21, so the lead 23 in the pot 21 normally does not flow through the passageway 35 into the mold chamber 29.

A cylindrical displacement piston 39 is located in the pot 21 above the molten lead 23. The diameter of the displacement piston 39 is less than the inner diameter of the pot 21, so there is a space between the edge of the piston 39 and the wall of the pot 21.

The displacement piston 39 is connected to a piston rod 41 connected to one end 43 of a pivot rod 45. The center 47 of the pivot rod 45 is connected to the wall of the pot 21, and the other end 49 of the pivot rod 45 is connected to a hydraulic piston and cylinder assembly 51. When the hydraulic cylinder assembly 51 is activated, the pivot rod 45 pivots about the center 47 of the rod 45 to lower the displacement piston 39 from the raised position, shown in FIG. 1, to the lowered position, shown in FIG. 2.

As the displacement piston 39 is lowered into the molten lead 23, as shown in FIG. 2, the level of the lead 23 rises, and lead flows through the passageways 35 and 37 into the mold chamber 29. The level of the lead 53 in the mold chamber 29 is raised until lead flows into and fills the molds 31. The molten lead 53 also heats the mold chamber 29 and the molds 31.

The displacement piston 39 is then raised by activating the hydraulic cylinder assembly 51 in the opposite direction. As the displacement piston 39 rises out of the lead 23 in the pot 21, the level of the lead 23 falls, and the lead 53 in the mold chamber 29 flows back through the passageways 35 and 37 into the pot 21, leaving the molten lead in the molds 31.

Figure 4:
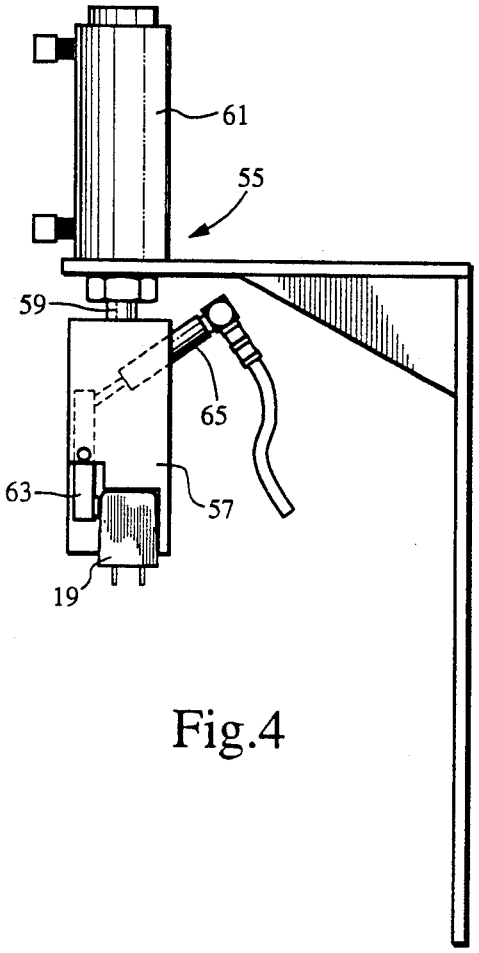
FIG. 4 is a side elevation of the battery handler in the raised position and gripping a battery.
Figure 5:
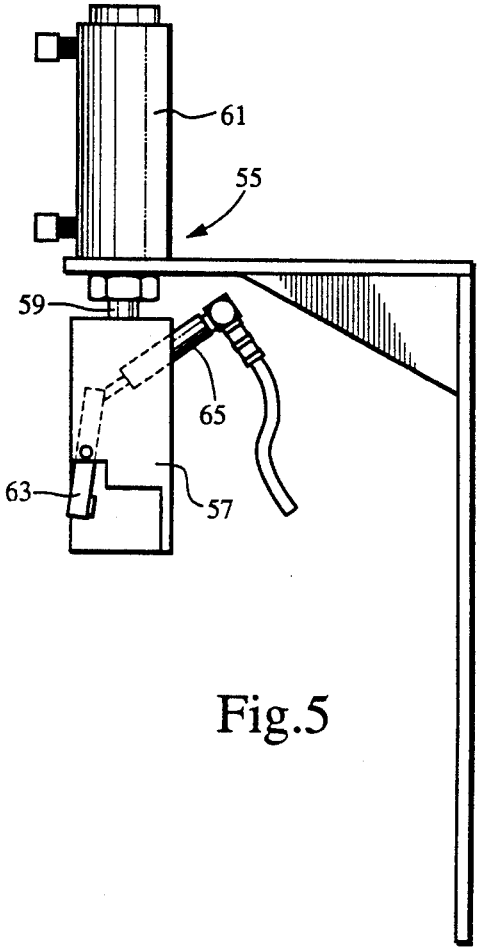
FIG. 5 is a side elevation of the battery handler in the raised position without a battery.

A battery handler 55 holds a battery 19 inverted above the molds 31. As shown in more detail in FIGS. 4 and 5, the battery handler 55 has a battery gripper 57 mounted on the lower end of a piston rod 59. The piston rod 59 is part of a hydraulic piston and cylinder assembly 61. When the piston and cylinder assembly 61 is actuated, the battery gripper 57 is raised and lowered. FIGS. 2, 4, and 5 show the battery gripper 57 in the raised position, while FIG. 1 shows the gripper 57 in the lowered position.

The battery gripper 57 has a hydraulically controlled finger 63 for gripping the battery 19, as shown in FIG. 4. A hydraulic piston and cylinder assembly 65 moves the finger 63 between a closed position, shown in FIG. 4, and an open position, shown in FIG. 5.

If desired, the battery handler 55 may be designed to pick up a battery 19 off of an adjacent table and to move the battery 19 to a position above the molds 31. When the molds 31 have been filled with molten lead, the battery handler 55 lowers the battery 19 until the lugs 17 on the battery 19 are inserted into the lead in the molds 31, as shown in FIG. 1.

The heating unit 27 in the thermal blanket 25 is then shut off, and a quantity of water is forced from an inlet 67 through a passageway 69 in the body 71 of the mold chamber 29 and out through an outlet 73. The water cools the mold chamber 29 and the molds 31 down to a preset temperature. When the predetermined temperature is reached, the water is shut off and air is forced through the passageway 69 to clear the water out. The lead in the molds 31 solidifies on the lugs 17 of the battery 19 to form straps 15, as shown in FIG. 7.

If necessary, the heating unit 27 in the thermal blanket 25 is then turned on to begin reheating the mold chamber 29. In some cases, the heat of the molten lead 53 sufficiently heats the mold chamber 29 and the molds 31, so there is no need for the heating unit 27 to reheat the mold chamber 29. The battery handler 55 raises the battery 19 out of the molds 31 and places the battery 19 to one side. The battery handler 55 can then obtain the next battery 19 for the operation.

The molten lead 23 in the pot 21 and the molten lead 53 in the mold chamber 29 is subject to oxidation, if not protected. Therefore, a stream of nitrogen is blown over the surface of the lead 23 in the pot 21 and the lead 53 in the mold chamber 29. The nitrogen is non-reactive with the lead 23 and 53, and forms a gaseous blanket between the lead 23 and 53 and the atmosphere. The nitrogen is blown through inlets 75 and 77, as shown in FIGS. 1-3.

The method of the invention begins when the battery handler 55 secures a battery 19 and holds the battery 19 inverted over the molds 31. The heating unit 27 in the thermal blanket 25 preheats the mold chamber 29 to a selected temperature.

The displacement piston 39 is then lowered into the molten lead 23 in the pot 21. The level of the lead 23 is raised until the lead 23 flows through the passageways 35 and 37 into the mold chamber 29. The level of the lead 53 in the mold chamber 29 is raised until the lead 53 flows into and fills the molds 31, as shown in FIG. 2.

The displacement piston 39 is then raised out of the lead 23 in the pot 21. The lead 53 in the mold chamber 29 flows back through the passageways 35 and 37 into the pot 21, leaving the molds 31 full of molten lead.

The battery handler 55 then lowers the battery 19 until the lugs 17 on the battery 19 enter the lead in the molds 31. Water is then forced through the passageway 69 in the floor 71 of the mold chamber 29 to cool the mold chamber 29 and the molds 31. When the temperature has reached a predetermined temperature, the water is shut off and air is forced through the passageway 69 to remove the water from the passageway 69.

If necessary, the heating unit 27 in the thermal blanket 25 is then turned on to begin reheating the mold chamber 29 for the next battery 19. The battery handler 55 raises the battery 19 out of the molds 31 and places the battery 19 to one side. The battery handler 55 then obtains the next battery 19 and positions the battery over the molds 31.

The apparatus and method of the invention have several advantages over the prior art. The simplicity of the design makes the apparatus relatively inexpensive to build and to operate. The operation is relatively fast and dependable. Further, the heat from the molten lead 53 in the mold chamber 29 sometimes provides sufficient heat to the mold chamber 29 and the molds 31, so there is no need for the heating unit 27 to reheat the mold chamber 29. Thus, the heating unit 27 would not have to extend around the mold chamber 29, facilitating the exchange of the mold chamber 29.

The invention has been shown in only one embodiment. It should be apparent to those skilled in the art that the invention is not so limited, but is susceptible to various changes and modifications without departing from the spirit of the invention.

We claim:

1. A method of manufacturing batteries, comprising the steps of:

lowering a displacement piston into a pot of molten lead to force the lead to flow into a mold chamber containing a mold to heat the chamber and to fill the mold;

raising the displacement piston to allow the molten lead to flow out of the mold chamber, leaving the lead in the mold;

lowering a battery until lugs on the battery plates enter the lead in the mold;

cooling the mold to harden the lead, forming straps on the lugs of the battery; and raising the battery to remove the battery from the mold after the straps have been formed.

2. A method of manufacturing batteries as recited in claim 1, wherein the cooling step further comprises forcing a liquid through passages within the body of the mold chamber for a selected time period.

3. A method of manufacturing batteries as recited in claim 2, wherein the cooling step further comprises forcing a gas through the passages in the body of the mold chamber to remove liquid from the passages.

4. A method of manufacturing batteries as recited in claim 2, wherein the liquid is water and the gas is air.

5. A method of manufacturing batteries as defined in claim 1, further comprising the step of blowing a non-reactive gas over the surface of the molten lead in the pot to prevent oxidation of the lead in the pot.

6. A method of manufacturing batteries as defined in claim 5, further comprising the step of blowing a non-reactive gas over the surface of the molten lead in the mold chamber to prevent oxidation of the lead in the mold chamber.

7. A method of manufacturing batteries as defined in claim 1, further comprising the step of blowing a non-reactive gas over the surface of the molten lead in the mold chamber to prevent oxidation of the lead in the mold chamber.

8. A method of manufacturing batteries as defined in claim 1, further comprising the step of heating the mold chamber to preheat the mold prior to lowering the displacement piston.

9. An apparatus for casting straps onto lugs on battery plates of a battery, the apparatus comprising:

a pot containing a quantity of molten lead;

a mold chamber;

a mold located in the mold chamber;

a displacement piston located in the pot;

displacement means for moving the displacement piston into the pot to cause some of the lead to flow out of the pot into the mold chamber to fill the mold, and for removing the displacement piston from the pot to allow the molten lead to flow out of the mold chamber back into the pot, leaving molten lead in the mold;

a battery handler for moving a battery until the lugs on the battery plates of the battery are inserted into the molten lead in the mold, and to remove the battery from the mold after straps have been formed on the lugs; and cooling means for cooling the mold chamber to harden the lead to form straps on the lugs.

10. An apparatus as recited in claim 9, further comprising heating means for heating the mold chamber.

11. An apparatus as recited in claim 10, wherein the heating means is an electric heating unit.

12. An apparatus as recited in claim 9, further comprising means for blowing a non-reactive gas over the surface of the molten lead in the pot to prevent oxidation of the lead in the pot.

13. An apparatus as recited in claim 12, further comprising means for blowing a non-reactive gas over the surface of the molten lead in the mold chamber to prevent oxidation of the lead in the mold chamber.

14. An apparatus as recited in claim 9, further comprising means for blowing a non-reactive gas over the surface of the molten lead in the mold chamber to prevent oxidation of the lead in the mold chamber.

15. An apparatus as recited in claim 9, wherein the cooling means is a fluid forced through passages in the walls of the mold chamber.

16. An apparatus as recited in claim 15, wherein the fluid is a liquid.

17. An apparatus as recited in claim 16, further comprising means for forcing a gas through the passages in the mold chamber to remove liquid from the passages.

18. An apparatus as recited in claim 17, wherein the liquid is water and the gas is air.

19. An apparatus for casting straps onto lugs on battery plates of a battery, the apparatus comprising:

a pot containing a quantity of molten lead;

a mold chamber having walls;

a mold located in the mold chamber;

a displacement piston located in the pot;

a piston and cylinder assembly for moving the displacement piston into the pot to cause some of the lead to flow out of the pot into the mold chamber to fill the mold, and for removing the displacement piston from the pot to allow the molten lead to flow out of the mold chamber back into the pot, leaving molten lead in the mold; and a battery handler for moving a battery until the lugs on the battery plates of the battery are inserted into the molten lead in the mold, and to remove the battery from the mold after straps have been formed on the lugs.

20. An apparatus for casting straps onto lugs on battery plates of a battery, as recited in claim 19, further comprising:

a fluid forced through passages in the walls of the mold chamber for cooling the mold chamber to harden the lead to form the straps on the lugs;

a heating unit for heating the mold chamber; and a non-reactive gas blown over the surface of the molten lead in the mold chamber to prevent oxidation of the lead in the mold chamber.

* * * * *